US006634634B2

(12) United States Patent
Sugimura

(10) Patent No.: US 6,634,634 B2
(45) Date of Patent: Oct. 21, 2003

(54) SHEET FEED APPARATUS AND IMAGE FORMING APPARATUS

(75) Inventor: Naoto Sugimura, Iwatsuki (JP)

(73) Assignee: Fuji Xerox, Co., Ltd., Tokyo (JP)

( * ) Notice: Subject to any disclaimer, the term of this patent is extended or adjusted under 35 U.S.C. 154(b) by 0 days.

(21) Appl. No.: 09/951,608

(22) Filed: Sep. 14, 2001

(65) Prior Publication Data

US 2002/0060389 A1 May 23, 2002

(30) Foreign Application Priority Data

Nov. 20, 2000 (JP) ..... 2000-353375

(51) Int. Cl.[7] ..... B65H 3/44
(52) U.S. Cl. ..... 271/9.11; 271/9.01
(58) Field of Search ..... 271/9.01, 9.11

(56) References Cited

U.S. PATENT DOCUMENTS 4,009,957 A * 3/1977 Suzuki et al. ..... 399/195
4,473,314 A * 9/1984 Imaizumi ..... 400/625
4,540,297 A * 9/1985 Imaizumi et al. ..... 400/625
4,674,734 A * 6/1987 Ibuchi ..... 271/9.11
4,953,844 A * 9/1990 Iwata et al. ..... 271/9.01
4,966,356 A * 10/1990 Ohyabu et al. ..... 271/9.11
6,273,414 B1 * 8/2001 Matsuo ..... 271/9.11

* cited by examiner

*Primary Examiner*—Donald P. Walsh
*Assistant Examiner*—Kaitlin Joerger
(74) *Attorney, Agent, or Firm*—Oliff & Berridge, PLC

(57) ABSTRACT

A registration roller 30 is preferably interposed between a first tangent line L1 passing through a handling portion between a first sheet feed roller 38 and a first handling member 42, and a second tangent line L2 passing through a handling portion between a second sheet feed roller 40 and a second handling member 44 (or the registration roller 30 may also be disposed so as to project out slightly from this range), and also the registration roller 30 may be preferably disposed downwardly of a horizontal line L3 passing through an upper end of the first sheet feed roller 38. In case where the first sheet feed roller 38, the second sheet feed roller 40 and the registration roller 30 are disposed so as to be as close as possible to one another, the height dimensions of a sheet feed apparatus 28 can be reduced to a minimum. Also, according to the above layout, since the registration roller 30 and the second sheet feed roller 40 are allowed to approach each other, a semilunar roller which has simple in structure can be used as the second sheet feed roller 40.

9 Claims, 10 Drawing Sheets

SHEET FEED APPARATUS AND IMAGE FORMING APPARATUS

BACKGROUND OF THE INVENTION

1. Field of the Invention

The present invention relates to an image forming apparatus for recording an image on a sheet-like record medium such as a sheet cut to a predetermined size in an image forming section thereof, and a sheet feed apparatus for delivering the sheet-like record medium to the image forming section of the image forming apparatus.

2. Description of the Related Art

As an image forming apparatus such as a printer and a facsimile, there are used image forming apparatus of various types such as an electrophotographic type, an ink jet type, and a thermal transfer type. In most of them, in the image forming section thereof, an image such as a character or a figure is formed on a sheet-like record medium such as a sheet cut to a predetermined size.

For example, in case of the ink jet type and thermal transfer type, an image is formed on a sheet in accordance with a digital signal.

Also, in case of the electrophotographic type and electrostatic recording type, by applying a toner to an electrostatic latent image on an image carrier, a toner image is formed; and, after then, the toner image is transferred and fixed onto a sheet.

In case of the sheet onto which the image is to be applied, generally, many units of such sheets are piled up on top of another and stored in a sheet feed apparatus which is disposed within the image forming apparatus and the sheets are sequentially supplied one by one.

The sheets to be stored in the sheet feed apparatus require proper replenishment and, in order to be able to facilitate the replenishment of the sheet, there is used a sheet tray formed in a cassette which can be mounted onto and removed from the main body of the sheet feed apparatus; and, actually, the sheets are supplied to and stored in the sheet tray.

In case of such sheet tray, there is a case where only a single sheet tray is disposed in an image forming apparatus but; in many cases, in order that sheets of different sizes can be selected for application of images, two or more cassettes or sheet trays are disposed.

Also, in some of image forming apparatus, as an annex thereto, there is disposed a hand-operated tray which is convenient for arbitrary use of sheets of various sizes and various kinds.

As an ordinary image forming apparatus including a mechanism which takes out sheets one by one from a sheet tray or a hand-operated tray and feeds them sequentially to a position where an image is to be formed, there is known an image forming apparatus having a structure shown in FIG. 10.

That is, in an image forming apparatus 200 shown in FIG. 10, two sheet trays of a cassette type 204, 206 are disposed downwardly of a hand-operated tray 202.

In the deeper side of the hand-operated tray 202, there are disposed a semilunar roller 210 and a handling member 212. The semilunar roller 210, in operation, can be contacted with an upper surface of the upper-most sheet P of sheets stored in the hand-operated tray 202 and, when rotated, can send out the upper-most sheet P toward a registration roller 214.

The handling member 212 is formed of material having large friction and is used to separate the lower-side sheets P, which are delivered together with the uppermost sheet P, from the upper-most sheet P.

The sheet teed apparatus of a type using the semilunar roller 210 is advantageous in that it is relatively simple in structure and is easy to control.

However, in the above-mentioned image forming apparatus 200, there are found the following problems.

In a structure where the hand-operated tray 202 is disposed in the upper-most stage and the sheet trays 204, 206 of a removable cassette type are disposed downwardly of the hand-operated tray 202, a sheet delivery route, which extends from sheet feed rollers 216, 218 for feeding sheets P in the sheet trays 204, 206, respectively, up to the registration roller 214, is long: that is, there is a problem that height dimensions of the sheet feed apparatus and thus the image forming apparatus are large.

Also, in the case of the semilunar roller being used as the sheet feed roller, since there is a limit on the sheet delivery quantity of the semilunar roller, in an intermediate portion of the sheet delivery route between the semilunar roller and registration roller, there must be disposed a turn roller which is used to deliver the sheet up to the registration roller. This increases the number of parts and complicates the structure of the sheet feed apparatus and thus the image forming apparatus.

By the way, instead of provision of the turn roller, as in the image forming apparatus 200, in case where the sheet feed rollers 216, 218 for feeding out the sheets P of the cassette-type sheet trays 204, 206 are composed of round rollers, a mechanism (such as an electromagnetic clutch) for controlling the delivery quantity of the sheets P must be connected to the sheet feed rollers 216, 218. This increases the number of parts as well as complicates the structure and control of the sheet feed apparatus and thus the image forming apparatus further.

SUMMARY OF THE INVENTION

The present invention aims at eliminating the above drawbacks found in the sheet feed apparatus according to the related art as well as in the image forming apparatus according to the related art. Accordingly, it is an object of the invention to provide an image forming apparatus which can control the height dimensions of a sheet feed apparatus down to a low level, can minimize the number of parts and thus can simplify the structure thereof.

According to a first aspect of the invention, there is provided A sheet feed apparatus comprising:

a first sheet tray;

a second sheet trays disposed in a lower direction with respect to the first sheet tray;

a first sheet feed roller contacting with top one of sheets piled up to be stored in the first sheet tray, the first sheet feed roller adapted to feed the sheets;

a first handling member adapted to cooperate with the first sheet feed roller to prevent a plurality of the sheets stored in the first sheet tray from being fed together;

a second sheet feed roller contacting with top one of sheets piled up to be stored in the second sheet tray, the second sheet feed roller adapted to feed the sheets stored in the second sheet tray;

a second handling member adapted to cooperate with the second sheet feed roller to prevent a plurality of the sheets stored in the second sheet tray from being fed together; and a registration roller adapted to nip the sheets fed out from the first sheet tray and the sheets fed out from the second sheet tray to deliver the both sheets to an image forming section disposed in an upper direction with respect to the first sheet feed roller, wherein the registration roller is disposed between a first tangent line passing through a handling portion between the first sheet feed roller and the first handling member, and a second tangent line passing through a handling portion between the second sheet feed roller and the second handling member.

Next, description will be given of an operation of the sheet feed apparatus according to the first aspect of the invention.

Firstly, the first sheet feed roller is contacted with the upper-most sheet of the sheets piled up and stored in the first sheet tray to feed the upper-most sheet to the registration roller side. In this operation, the first handling member cooperates with the first sheet feed roller to prevent two or more units of the sheets from being fed together. The first handling member is used to prevent the sheets arranged downwardly of the upper-most sheet from being fed together with the upper-most sheet. Therefore, the first handling member, naturally, is disposed downwardly of the first sheet feed roller and the sheet delivery direction downstream side of the first handling member is inclined obliquely upwardly.

Next, the second sheet feed roller is contacted with the sheets piled up and stored in the second sheet tray to thereby feed the sheets to the registration roller side. In this operation, the second handling member cooperates with the second sheet feed roller to prevent two or more units of the sheets from being fed together. Since the second handling member is also a member to prevent the sheets arranged downwardly of the upper-most sheet from being fed together with the upper-most sheet, the second handling member, naturally, is disposed downwardly of the second sheet feed roller and the sheet delivery direction downstream side of the second handling member is inclined obliquely upwardly.

In case where the sheet is fed to the registration roller, the sheet is then delivered to the image forming section by the registration roller.

Here, since the registration roller is interposed between the first tangent line passing through the handling portion between the first sheet feed roller and first handling member, and the second tangent line passing through the handling portion between the second sheet feed roller and second handling member, in case where the first sheet feed roller, the second sheet feed roller and the registration roller are disposed such that they are close to one another, the position of the registration roller can be lowered, thereby being able to minimize the height dimensions of the sheet feed apparatus.

According to this, in response to requirement, as the first sheet feed roller and the second sheet feed roller, there can be used a semilunar roller which has simple in structure and is inexpensive, thereby eliminating the need for provision of turn rollers respectively between the second sheet feed roller and registration roller as well as between the first sheet feed roller and registration roller, which can in turn prevent the sheet feed apparatus from being complicated in structure.

According to a second aspect of the invention, there is provided A sheet feed apparatus comprising:

a first sheet tray;

a second sheet trays disposed in a lower direction with respect to the first sheet tray;

a first sheet feed roller contacting with top one of sheets piled up to be stored in the first sheet tray, the first sheet feed roller adapted to feed the sheets;

a first handling member adapted to cooperate with the first sheet feed roller to prevent a plurality of the sheets stored in the first sheet tray from being fed together;

a second sheet feed roller contacting with top one of sheets piled up to be stored in the second sheet tray, the second sheet feed roller adapted to feed the sheets stored in the second sheet tray;

a second handling member adapted to cooperate with the second sheet feed roller to prevent a plurality of the sheets stored in the second sheet tray from being fed together; and a registration roller adapted to nip the sheets fed out from the first sheet tray and the sheets fed out from the second sheet tray to deliver the both sheets to an image forming section disposed in an upper direction with respect to the first sheet feed roller, wherein the registration roller is disposed between a horizontal line passing through an upper end of the first sheet feed roller and a second tangent line passing through a handling portion between the second sheet feed roller and the second handling member.

Next, description will be given of the operation of the sheet feed apparatus according to the second aspect of the invention.

Firstly, the first sheet feed roller is contacted with the upper-most sheet of the sheets piled up and stored in the first sheet tray to feed the upper-most sheet to the registration roller side. In this operation, the first handling member cooperates together with the first sheet feed roller to prevent the sheet from being fed together with one or more of the remaining sheets. The first handling member is used to prevent the sheets arranged downwardly of the upper-most sheet from being fed together with the upper-most sheet. Therefore, the first handling member, naturally, is disposed downwardly of the first sheet feed roller and the sheet delivery direction downstream side of the first handling member is inclined obliquely upwardly.

Next, the second sheet feed roller is contacted with the sheets piled up and stored in the second sheet tray to feed the sheets to the registration roller side. In this operation, the second handling member cooperates with the second sheet feed roller to prevent two or more units of the sheets from being fed together. Since the second handling member also prevents the sheets arranged downwardly of the upper-most sheet from being fed together with the upper-most sheet, the second handling member, naturally, is disposed downwardly of the second sheet feed roller and the sheet delivery direction downstream side of the second handling member is inclined obliquely upwardly.

In case where the sheet is fed to the registration roller, the sheet is then delivered to the image forming section by the registration roller.

Here, since the registration roller is interposed between a horizontal line passing through the upper end of the first sheet feed roller and a second tangent line passing through the handling portion between the second sheet feed roller and second handling member, the height dimensions of the sheet feed apparatus can be reduced to a minimum.

According to this, in response to requirement, as the first sheet feed roller and second sheet feed roller, there can be used a semilunar roller which is simple in structure and is inexpensive, thereby eliminating the need for provision of turn rollers respectively between the second sheet feed roller and registration roller as well as between the first sheet feed roller and registration roller, which can in turn prevent the sheet feed apparatus from being complicated in structure.

According to a third aspect of the invention, there is provided a sheet feed apparatus comprising:

a first sheet tray;

a second sheet trays disposed in a lower direction with respect to the first sheet tray;

a first sheet feed roller contacting with top one of sheets piled up to be stored in the first sheet tray, the first sheet feed roller adapted to feed the sheets;

a first handling member adapted to cooperate with the first sheet feed roller to prevent a plurality of the sheets stored in the first sheet tray from being fed together;

a second sheet feed roller contacting with top one of sheets piled up to be stored in the second sheet tray, the second sheet feed roller adapted to feed the sheets stored in the second sheet tray;

a second handling member adapted to cooperate with the second sheet feed roller to prevent a plurality of the sheets stored in the second sheet tray from being fed together; and a registration roller adapted to nip the sheets fed out from the first sheet tray and the sheets fed out from the second sheet tray to deliver the both sheets to an image forming section disposed in an upper direction with respect to the first sheet feed roller, wherein the registration roller has two sub rollers; and a distance from a nip portion of the registration roller between the sub rollers to a handling portion between the second sheet feed roller and the second handling member is smaller than a distance from the nip portion of the registration roller to a nip portion between the first sheet feed roller and the first handling member.

In relation to a sheet feed apparatus according to a third aspect of the invention, there can also be obtained similar effects to the sheet feed apparatuses according to the first and second aspects of the invention.

According to a fourth aspect of the invention, there is provided the sheet feed apparatus according to any one of the first to third aspects of the invention, wherein in a horizontal direction, the second sheet feed roller is disposed between the first sheet feed roller and the registration roller.

According to a fifth aspect of the invention, there is provided the sheet feed apparatus according to the first to fourth aspects of the invention, further comprising a first guide portion disposed between the first sheet feed roller and the registration roller, the first guide portion adapted to guide the sheets fed from the first sheet tray toward the registration roller, wherein the first guide portion comprises:

a first sheet curve forming portion adapted to curve a delivery direction of the sheet fed from the first sheet tray; and a second sheet curve forming portion disposed in downstream of the delivery direction with respect to the first sheet curve forming portion, the second sheet curve forming portion adapted to curve the delivery direction of the sheet fed from the first sheet tray in an opposite direction to the curving direction by the first curve forming portion.

According to a sixth aspect of the invention, there is provided the sheet feed apparatus according to the first to fifth aspects of the invention, further comprising a second guide portion disposed between the second sheet feed roller and the registration roller, the second guide portion adapted to guide the sheets fed from the second sheet tray toward the registration roller, wherein the second guide portion comprises at least one small-diameter roller contacting with any one of surfaces of the sheet fed from the second sheet tray to rotate.

According to a seventh aspect of the invention, there is provided an image forming apparatus, An image forming apparatus comprising:

an image forming section; and the sheet feed apparatus according to the first to sixth aspects of the invention.

In the case of the image forming apparatus according to in the seventh aspect of the invention, the sheet fed from the sheet feed apparatus is delivered to the image forming section by the registration roller and, in the image forming section, image is recorded on the sheet.

As described in the first aspect of the invention, since the height dimensions of the sheet feed apparatus can be controlled down to a minimum, the height dimensions of the image forming apparatus can also be minimized.

DETAILED DESCRIPTION OF THE PREFERRED EMBODIMENTS

Now, description will be given below of an embodiment of an image forming apparatus according to the invention with reference to FIGS. 1 to 9.

Figure 2:
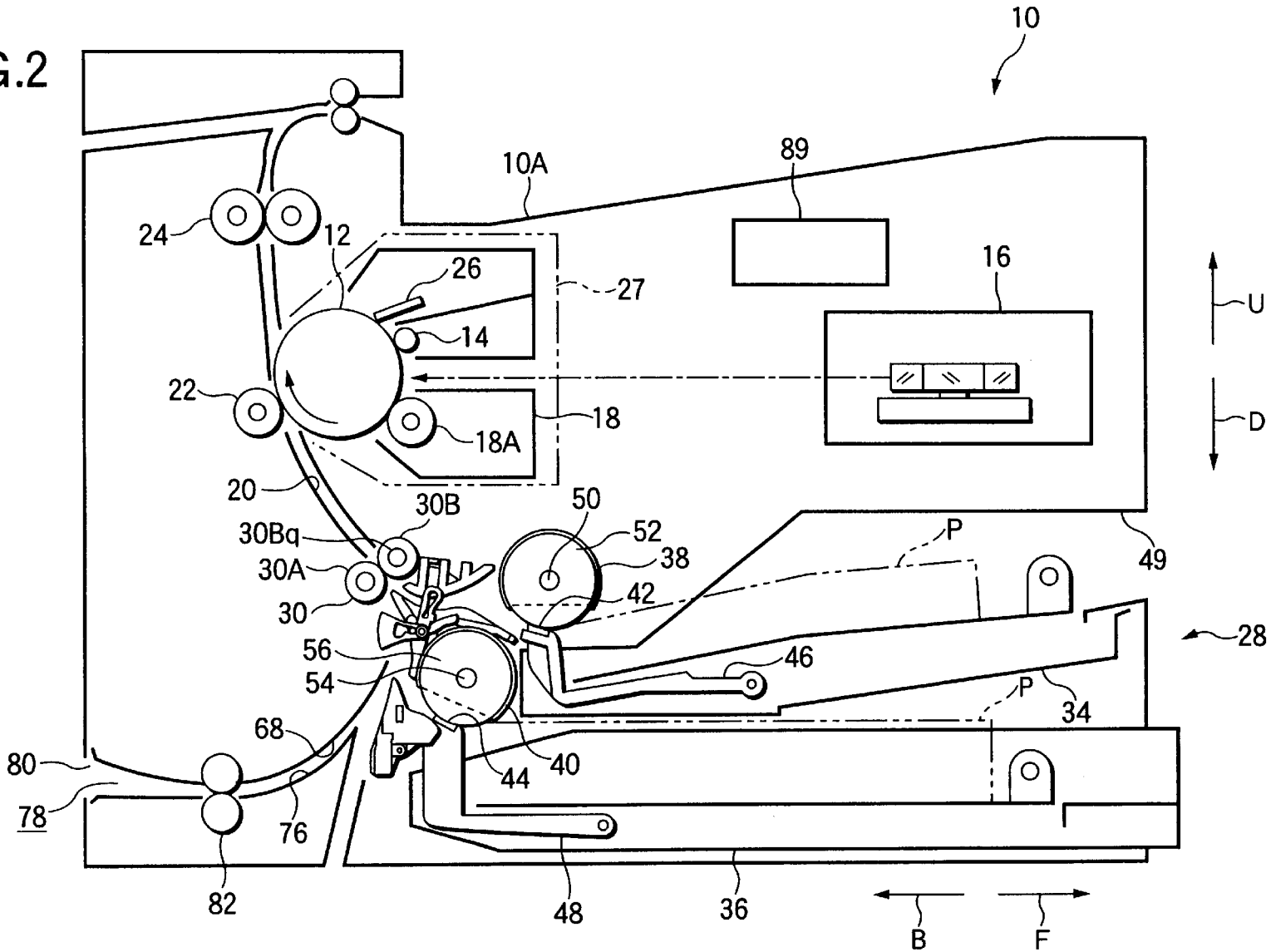
FIG. 2 is a schematic view of structure of the imaging forming apparatus according to the embodiment of the invention.

As shown in FIG. 2, an image forming apparatus 10 comprises; an image carrier (so called photosensitive drum) 12 which is electrically charged uniformly, and then is applied image light thereto, thereby forming an electrostatic image on a surface thereof; a charging device 14 for electrically charging the surface of the image carrier 12; an image write device 16 for radiating the image light onto the image carrier 12 in accordance with image data, thereby forming the latent image due to a difference of electrostatic potentials; a developing device 18 for transferring a toner to the latent image selectively, thereby visualizing the latent image; a transfer device 22 for transferring the toner image of the surface of the image carrier to a record sheet supplied along a sheet delivery route 20; a fixing device 24 for applying heat and pressure to the toner image on the record sheet, thereby fixing the toner image to the record sheet; and a cleaner 26 for cleaning the toner remaining on the image carrier after transferring the toner image.

Here, the image carrier 12, charging device 14, developing device 18 and cleaner 26, as a developing unit, can be mounted into and removed from a main body frame (not shown) disposed within an interior portion of the image forming apparatus 10 simply by opening a top plate 10A of the image forming apparatus 10.

Also, in the lower portion of the image forming apparatus 10, there are disposed a sheet feed apparatus 28 which stores record sheets therein and feeds out therefrom the record sheets one by one, and a registration roller 30 which delivers the record sheets fed out from the sheet feed apparatus 28 to a transfer position of the toner image at a predetermined timing.

The image carrier 12 includes a photosensitive body layer on a back surface thereof and potential of an exposure portion thereof can be attenuated due to exposing after the image carrier 12 is uniformly charged.

The charging device 14 is a roller-like member which can be contacted with the image carrier 12 and, in case where a voltage is applied between the charging device 14 and the image carrier 12, an electric discharge is generated within a minute gap in the vicinity of their contact portion, thereby electrically charging the surface of the image carrier 12 almost uniformly.

As the charging device, there can be used not only the above-mentioned charging device 14 but also a charging device of a type structured such that a high voltage is applied to an electrode wire, thereby electrically charging the image carrier 12 due to an action of a corona discharge.

The image write device 16 is a device which allows a blinking laser to scan the peripheral surface of the image carrier 12 and forms the electrostatic latent image, which is based on the image data, on the peripheral surface of the image carrier 12.

By the way, as the image write device, alternatively, it is also possible to use a device in which there are arranged light emitting elements such as LEDs and these light emitting elements are allowed to blink in accordance with the image data.

The developing device 18 includes a cylindrical-shaped developing roller 18A disposed so as to be adjacent to and opposed to the image carrier 12. A developing bias voltage is applied between the developing roller 18A and image carrier 12.

That is, with an application of the developing bias voltage, a developing bias electric field is formed between the developing roller 18A and image carrier 12, with the result that a toner having an electric charge is transferred to the exposure portion of the image carrier 12, thereby forming a visible image.

The transfer device 22 is a roller-like member which is disposed so as to be opposed to the image carrier 12 and also which forms a transfer electric field between the image carrier 12 and itself, thereby transferring the toner image onto the record sheet passing through the transfer device 22.

(Sheet Feed Apparatus)

The sheet feed apparatus 28 comprises a first sheet tray 34, a second sheet tray 36 disposed downwardly of the first sheet tray 34, a first sheet feed roller 38 for feeding sheets from the upper sheet tray 34 and a second sheet feed roller 40 for feeding the sheets from the lower sheet tray 36, a first handling member 42 which is pressure-contacted with the first sheet feed roller 38, a second handling member 44 which is pressure-contacted with the second sheet feed roller 40, a holder 46 which is rotatably mounted on the first sheet tray 34 to support the first handling member 42, and a holder 48 rotatably mounted on the second sheet tray 36 for supporting the second handling member 44.

The second sheet tray 36, which is disposed on the lower side, can be mounted on and removed from the main body frame of the image forming apparatus 10 as a cassette, and can be pulled out in an opposite direction (in FIG. 2, in the direction of an arrow mark F) to a direction in which the sheets are fed out.

Also, the upper-side sheet tray 34 is a hand-operated tray structured such that, in use, a sheet having an arbitrary size can be easily inserted into the sheet tray 34 through an opening 49 formed in a side portion of the image forming apparatus 10 on the arrow mark F direction side thereof.

The first sheet feed roller 38 is a semilunar roller, in which a peripheral surface thereof is cut away partly. When the first sheet feed roller is driven and rotated, the peripheral surface thereof is contacted with the upper-most one of the sheets carried on the sheet tray to feed the upper-most sheet P; that is, the first sheet feed roller 38 feeds the sheets P one by one sequentially in this manner.

The first handling member 42 is supported by the holder 46 which is rotatably mounted on the first sheet tray 34, while the first handling member 42 is energized toward the first sheet feed roller 38 by an elastic member such as a spring.

Also, on a shaft 50 of the first sheet feed roller 38, there is supported a core roller 52 in such a manner that it can be rotated freely.

The first handling member 42 is always in contact with the core roller 52. Also, when the sheets P fed out by the first sheet feed roller 38 are delivered by the registration roller 30, the first handling member 42 prevents the sheets P arranged downwardly of the upper-most sheet P from following the upper-most sheet P.

The second handling member 44 is supported by the holder 48 which is rotatably mounted on the second sheet tray 36, while the second handling member 44 is energized toward the second sheet feed roller 40 by an elastic member such as a spring.

By the way, on a shaft 54 of the second sheet feed roller 40 as well, there is disposed a core roller 56 which is similar to the core roller 52 disposed on the shaft 50 of the first sheet feed roller 38.

The second handling member 44 is always in contact with the core roller 56. Also, when the sheets P fed out by the second sheet feed roller 40 are delivered by the registration roller 30, the second handling member 44 prevents the sheets P arranged downwardly of the upper-most sheet P from following the upper-most sheet P.

The first sheet feed roller 38 is disposed upwardly of an end portion of the first sheet tray 34 on a deep side of the image forming apparatus 10 (in FIG. 2, on an arrow mark B direction side), that is, at a position where the sheets P stored in the first sheet tray 34 can be contacted with the first sheet feed roller 38. The first sheet feed roller 38 can be rotated by a motor (not shown) which can be controlled by a control unit 89 to be discussed later.

The second sheet feed roller 40 is disposed upwardly of an end portion of the second sheet tray 36 on the deep side of the image forming apparatus 10 (in FIG. 2, on the arrow mark B direction side), that is, at a position where the sheets P stored in the second sheet tray 36 can be contacted with the second sheet feed roller 40. The second sheet feed roller 40 can be rotated by a motor (not shown) which can be controlled by the control unit 89 to be discussed later.

Figure 1:
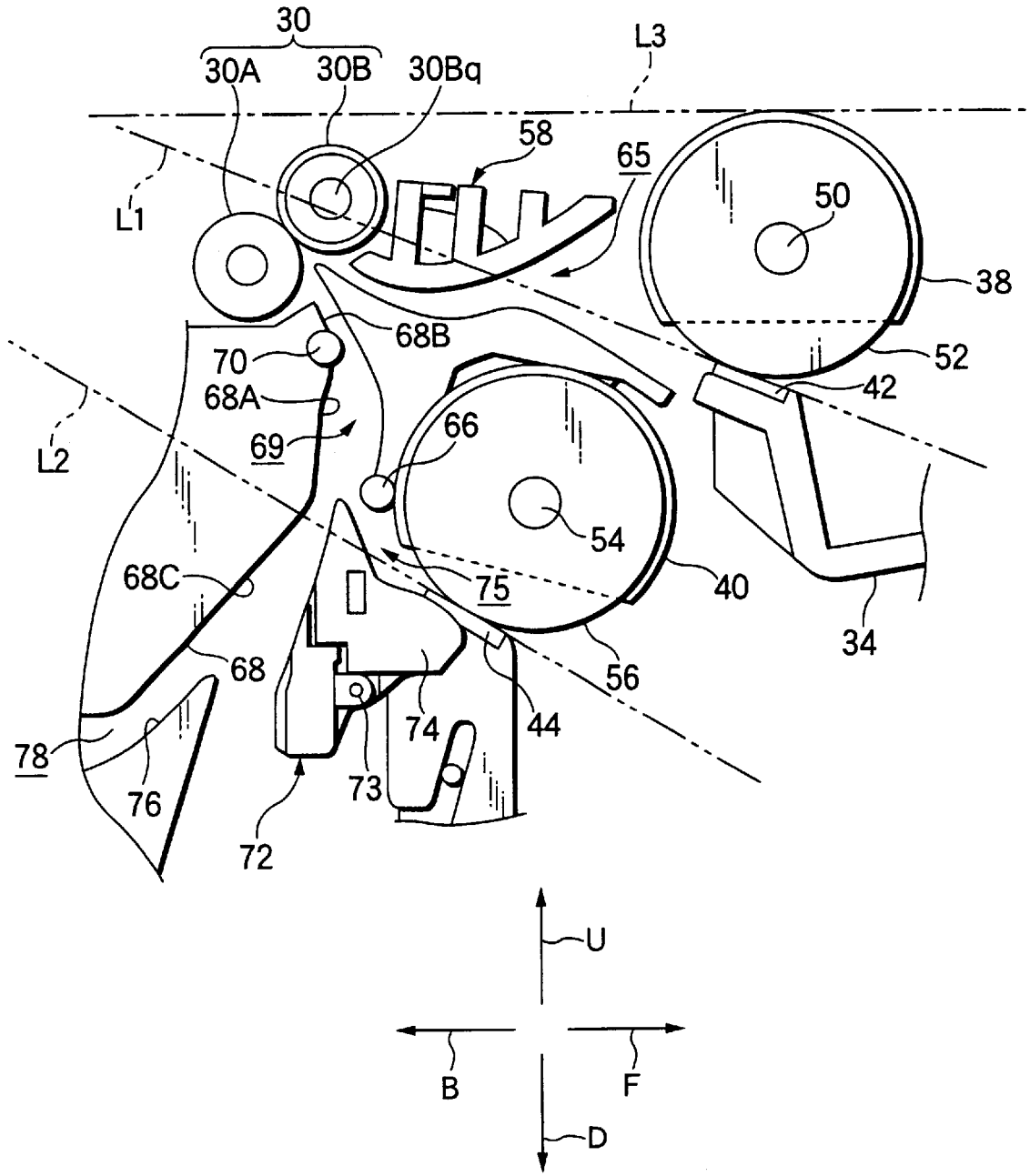
FIG. 1 is a side view of main portions of a sheet feed apparatus employed in an image forming apparatus according to an embodiment of the invention.

As shown in FIG. 1, in the arrow mark B direction of the first sheet feed roller 38, there is disposed the registration roller 30 composed of a roller 30A disposed in the arrow mark B direction, and a roller 30B disposed in the arrow mark F direction and pressure-contacting with the roller 30A.

These rollers 30A and 30B is rotated by a motor (not shown) controlled by the control unit 89 to be discussed later.

By the way, the second sheet feed roller 40 is interposed between the first sheet feed roller 38 and registration roller 30.

Here, preferably, a nip point between the rollers 30A and 30B of the registration roller 30 is set between a first tangent line L1, which passes through the handling portion (contact portion) between the first sheet feed roller 38 and first handling member 42, and a second tangent line L2 passing through the handling portion (contact portion) between the second sheet feed roller 40 and second handling member 44. However, the nip point may also be set so as to project slightly upwardly of the first tangent line L1.

In the present embodiment, the registration roller 30 is disposed downwardly of a horizontal line passing through the upper end of the first sheet feed roller 38.

Also, the second sheet feed roller 40 is interposed between the first sheet feed roller 38 and registration roller 30 in the horizontal direction thereof.

In case where the first sheet feed roller 38, second sheet feed roller 40 and registration roller 30 are disposed so as to be as near as possible to one another while maintaining the above-mentioned position relationship, there can be realized a reasonable arrangement in which the height dimensions of the sheet feed apparatus 28 (in FIG. 1, the dimensions in an arrow mark U direction and in an arrow mark D direction) as well as the depth dimensions thereof (in FIG. 1, the dimensions in the arrow mark F direction and in the arrow mark B direction) are both minimized.

Also, in the present embodiment, a distance from the nip point between rollers 30A, 30B of the registration roller 30 to the nip point between the second sheet feed roller 40 and second handling member 44 is set smaller than a distance from the nip point between the rollers 30A, 30B of the registration roller 30 to the nip point between the first sheet feed roller 38 and first handling member 42.

Figure 3:
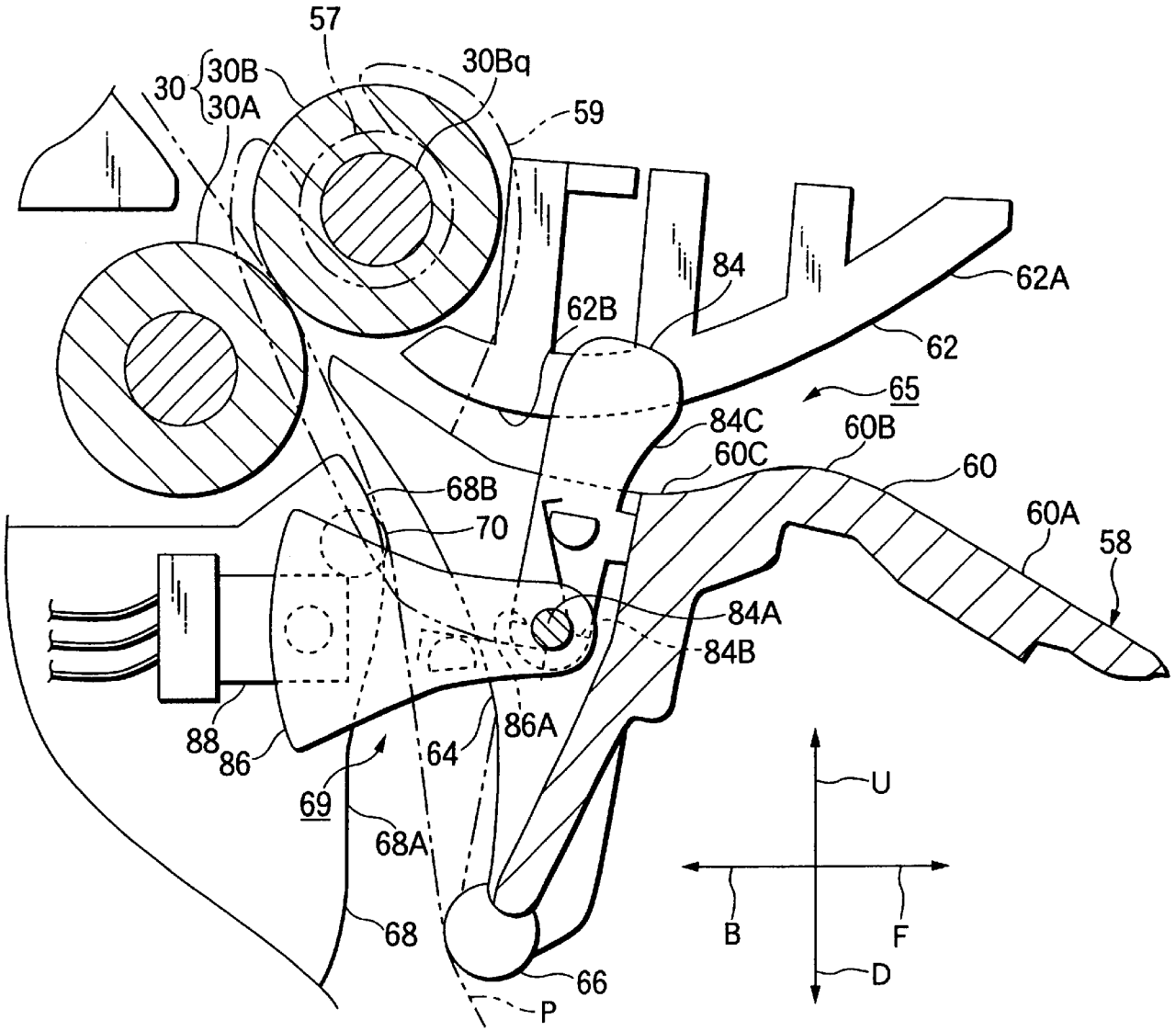
FIG. 3 is an enlarged section view of the main portions of the sheet feed apparatus employed in the image forming apparatus according to the embodiment of the invention.
Figure 4:
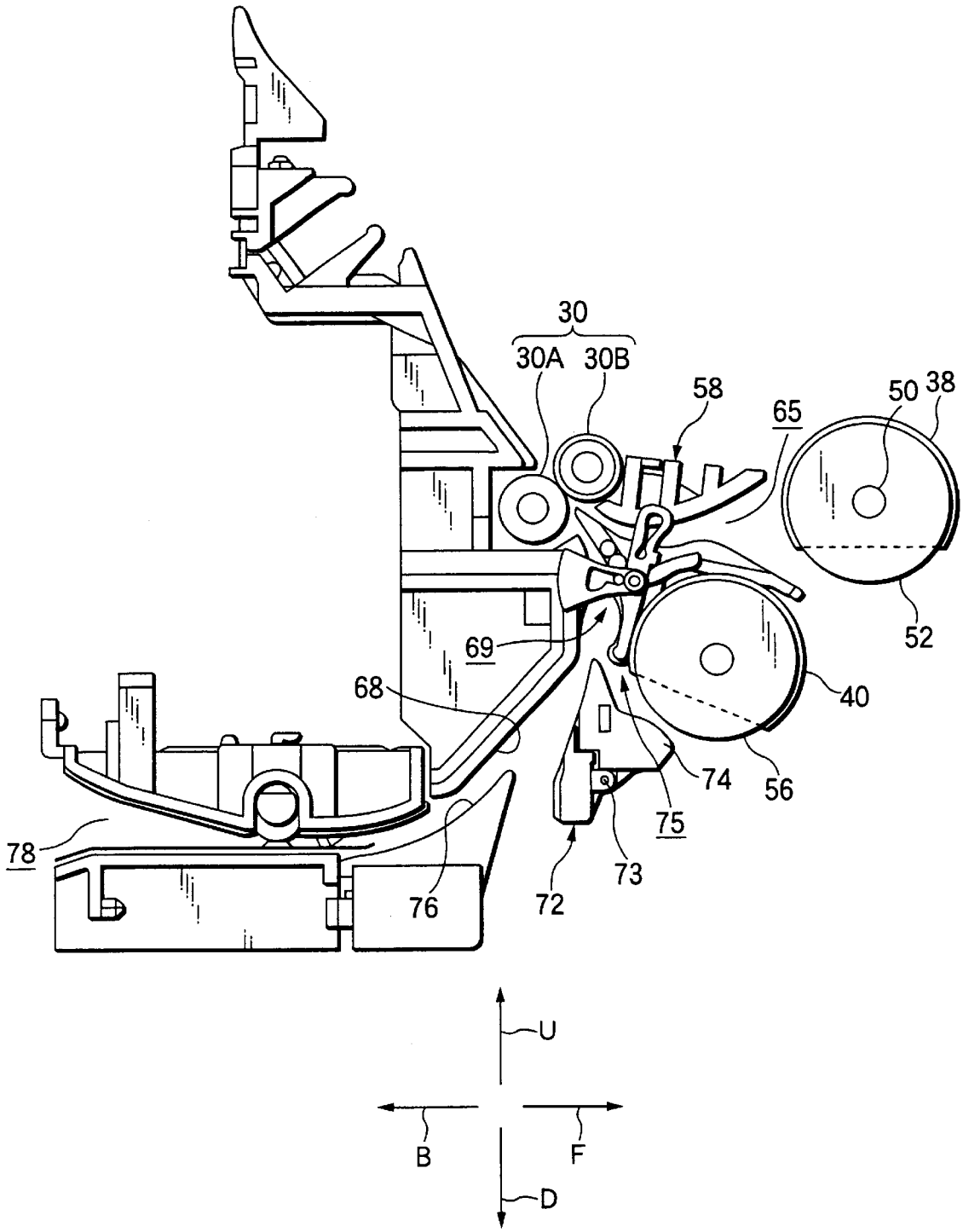
FIG. 4 is a schematic view of the structure of the sheet feed apparatus, showing a normal state thereof.

As shown in FIGS. 3 and 4, on a shaft 30B*a* of the roller 30B of the registration roller 30, there is mounted an upper-side guide assembly 58 through a ring 57 in such a manner that it can be rotated as well as can be mounted and removed.

In both sheet-width-directions (in FIG. 3, front-and-back-directions of the drawing) of the upper-side assembly 58, there are disposed bearings 59 each having a substantially C-like shape: that is, by deforming the bearings 59 elastically, the upper-side assembly 58 can be mounted onto and removed from the shaft 30B*a*.

The upper-side assembly 58 comprises a guide surface 60 for guiding the lower surface (when carried on the tray) of the sheet P fed out from the first sheet feed roller 38, a guide surface 62 for guiding an upper surface (when carried on the tray) of the sheet P fed from the first sheet feed roller 38, and a guide surface 64 for guiding an upper surface (when carried on the tray) of the sheet P fed from the second sheet teed roller 40.

In FIGS. 3 and 4, there is shown the upper-side assembly 58 in a normal state of the image forming apparatus 10.

As shown in FIGS. 3 and 4, the guide surface 60 comprises: a linear portion 60A, which is formed at the first sheet feed roller 38 side and has a section, along the sheet delivery direction, in substantially linear shape; a first arc portion 60B which is formed at the registration roller 30 side of the linear portion 60A and has a section, along the sheet delivery direction, in a projecting arc shape: and, a second arc portion 60C which is formed on the registration roller 30 side of the first arc portion 60B and has a section, along the sheet delivery direction, in a recessed arc shape.

On the other hand, a guide surface 62 is disposed so as to be opposed to the guide surface 60 and also the guide surface 62 comprises: an upper-side plane portion 62A which is disposed at a position substantially opposed to a portion of the linear portion 60A of the guide surface 60 and the first arc portion 60B and has a section, along the sheet delivery direction, in a substantially linear shape; and, an arc portion 62B which is disposed at a position opposed to the second arc portion 60C and has a section, along the sheet delivery direction, in a projecting arc shape.

By the way, a gap between the two guide surfaces 60 and 62 narrows gradually as they approach the registration roller 30, while this gap provides a delivery route 65 along which the sheets P delivered there by the first sheet feed roller 38 can be guided toward the registration roller 30.

Also, in the upper-side guide assembly 58, at a lower end of a guide surface 64, there is disposed a small-diameter roller 66 in such a manner that the roller 6G can be freely rotated. This roller 66 is structured such that, in case where the roller 66 is contacted with the sheet P being delivered, the roller 66 is rotated.

Next, as shown in FIG. 1, in the main body frame side of the image forming apparatus 10, specifically, in the arrow mark B direction of the upper-side guide assembly 58, there is disposed a fixed guide surface 68.

The fixed guide surface 68 comprises a vertical surface portion 68A which extend substantially vertically and is disposed at a position opposed to the guide surface 64, an inclined portion 68B connecting smoothly with an upper end of the vertical surface portion 68A and extending obliquely upwardly in the arrow mark B direction, and an arc portion 68C which connects smoothly with a lower end of the vertical surface portion 68A and has a section, along the sheet delivery direction, in a downwardly projecting shape.

A space formed between the fixed guide surface 68 and guide surface 64 provides a delivery route 69 along which the sheets P delivered there from below can be guided toward the registration roller 30.

On the fixed guide surface 68, specifically, on the connecting portion between the vertical surface portion 68A and inclined portion 68B of the fixed guide surface 68, there is disposed a small-diameter roller 70 in such a manner that the roller 70 can be rotated freely.

The roller 70 projects partly from the fixed guide surface 68 and thus, in case where the projecting portion of the roller 70 is contacted with the sheet P, the roller 70 is rotated.

Normally, the upper-side guide assembly 58 is locked by a lock pawl (not shown) so that the guide surface 64 and the vertical surface portion 68R can be disposed at positions (positions shown in FIGS. 1, 3 and 4) where they are opposed to each other.

Figure 5:
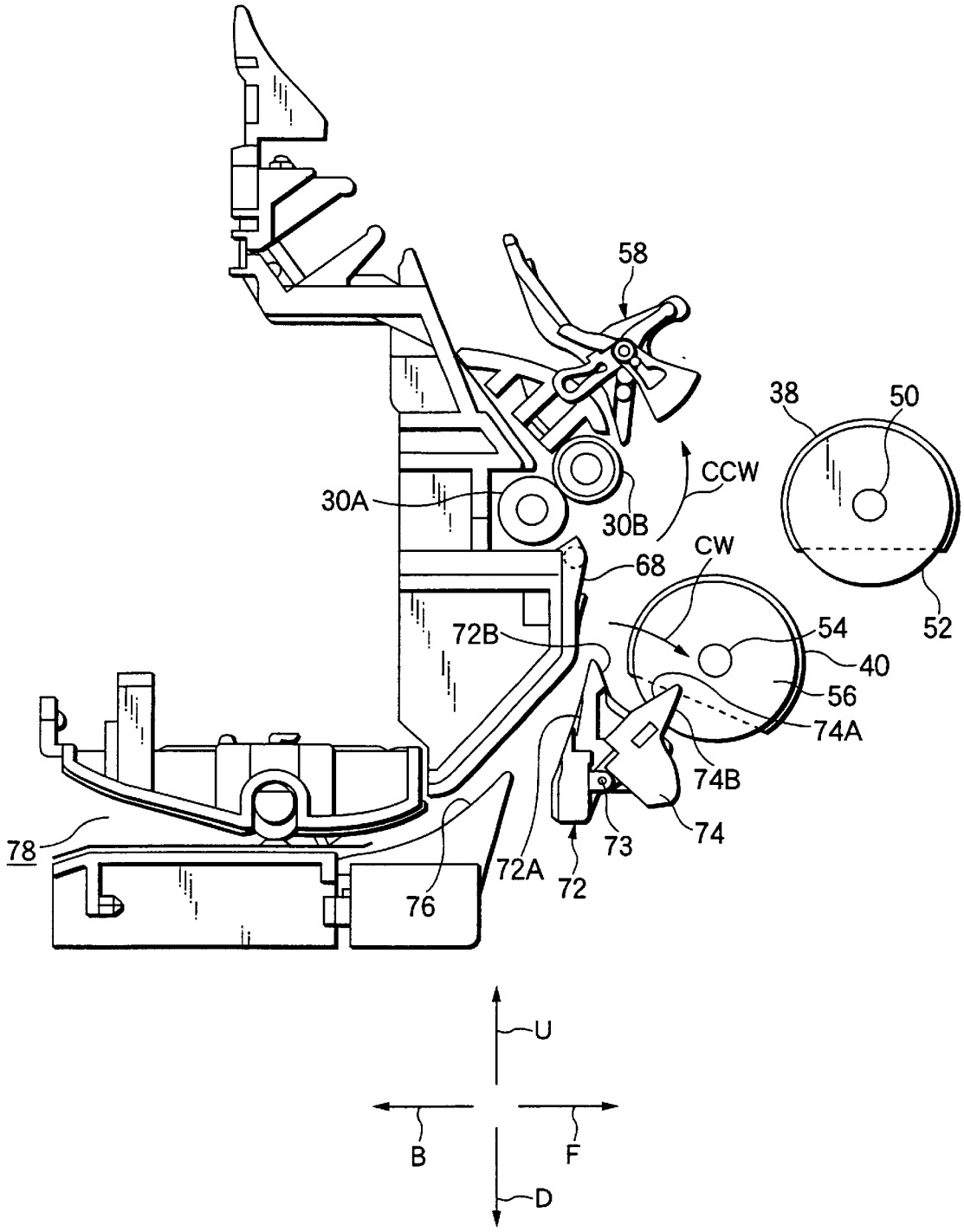
FIG. 5 is a schematic view of the structure of the sheet feed apparatus, showing a state of maintenance when a sheet is caught.

The upper-side guide assembly 58, as shown in FIG. 5, can be rotated in a direction of an arrow mark CCW (in FIG. 5, in a counter-clockwise direction) by removing the locked state of the upper-side guide assembly 58 by the lock pawl, with the result that the vertical surface portion 68A of the fixed guide surface 68 is exposed greatly in the upward direction.

Further, on the main body frame side of the image forming apparatus 10, specifically, obliquely downwardly in the arrow mark B direction of the second sheet feed roller 40, there is disposed a lower-side guide assembly 72.

As shown in FIG. 5, the lower-side guide assembly 72 includes a fixed guide surface 72A opposed to the fixed guide surface 68, and a fixed guide surface 72E which is used to guide the sheet P delivered there from the second sheet feed roller 40 toward the registration 30 side and has a section, along the sheet delivery direction, in a substantially recessed-arc shape.

The fixed guide surface 72B is formed only in a central portion of the lower-side guide assembly 72 in a sheet width direction (in FIG. 5, a front-and-back direction of the drawing) thereof perpendicular to the sheet delivery direction; and, on the both ends of the fixed guide surface 728 in the sheet width direction, there is disposed a movable guide member 74.

The movable guide member 74 is rotatably mounted on a shaft 73 of the lower-side guide assembly 72; and, the movable guide member 74 includes a guide surface 74A formed so as to have the same sectional shape as the fixed guide surface 72 formed in the central portion of the lower-side guide assembly 72, and a guide surface 74B formed so as to have the same sectional shape as the fixed guide surface 72B formed in the central portion of the lower-side guide assembly 72.

Normally, the movable guide member 74 is fixed by a lock mechanism in such a manner that the guide surface 74A is situated on the sheet-width-direction extension line of the fixed guide surface 72B (see FIGS. 1, 2 and 4).

In case where the locked state of the movable guide member 74 by the lock mechanism is removed, as shown in FIG. 5, the movable guide member 74 can be rotated in a direction of an arrow mark CW (in FIG. 5, in a clockwise direction) in relation to the shaft 73, with the result that the gap between the fixed guide surface 68 and the movable guide member 74 can be spread open greatly in the upward direction.

As shown in FIG. 1, the gap between the fixed guide surface 72B and the second sheet feed roller 40 as well as the gap between the guide surface 74B and second sheet feed roller 40 provide a delivery route 75 along which the sheet P delivered by the second sheet feed roller 40 can be guided toward the registration roller 30.

As shown in FIGS. 2 and 4, downwardly of the fixed guide surface 68, there is disposed a guide surface 76. A gap between the fixed guide surface 68 and guide surface 76 provides a delivery route 78 for the sheets P, while an end of the delivery route 78 in the arrow mark B direction is connected with an opening 80 formed in a side surface of the image forming apparatus 10.

In an intermediate portion of the delivery route 78, there are disposed a pair of rollers 82 which are used to deliver the sheets P. These rollers 82 is rotated by a motor (not shown) and can deliver the sheets P in the arrow mark B direction as well as in the arrow mark F direction.

(Sheet Detection Mechanism)

As shown in FIG. 3, the upper-side guide assembly 58 comprises a first actuator 84 which is used to detect the sheets P fed into the delivery route 65, and a second actuator 86 used to detect the sheets P fed into the delivery route 69.

The first actuator 84 includes a shaft 84A formed integrally with the first actuator 84, while the shaft 84A is rotatably inserted into a hole (not shown) of the upper-side guide assembly 58. Thus, the first actuator 84 can be swung on the shaft 84A.

Here, the first actuator 84 is energized in a clockwise direction in FIG. 3 by a torsion spring (not shown) (one end of the torsion spring is secured to the upper-side guide assembly 58, the other end is secured to the first actuator 84, and the torsion spring has a strong torsion force) and, normally, the first actuator 84 is present at a position shown in FIG. 3 while the side surface thereof is in contact with the upper-side guide assembly 58.

On the other hand, the second actuator 86 is energized in a counterclockwise direction in FIG. 3 by a torsion spring (not shown) (one end of the torsion spring is secured to the first actuator 84, the other end is secured to the second actuator 86, and the torsion spring is weaker in the torsion force than the torsion spring of the first actuator 84).

By the way, the second actuator 86 includes a projection 86A formed integrally therewith and, normally, the projection 86A is contacted with a projection 84B formed integrally with the first actuator 84, that is, the second actuator 86 is normally situated at a position shown in FIG. 3.

On the fixed guide surface 68 that is present on the main. body frame side, there is disposed an optical sensor 88 of a light transmission type. The optical sensor 88 is connected to a control unit 89 (see FIG. 2) which is used to control the whole image forming apparatus.

Normally, the second actuator 86 crosses the delivery route 69 and a leading end portion of the second actuator 86 shields the optical beam of the optical sensor 88.

In case where the sheet P is contacted with the second actuator 86, the second actuator 86 is rotated clockwise in FIG. 3 to allow the light beam of the optical sensor 88 to penetrate, whereby the optical sensor 88 detects that the sheet P has advanced into the delivery route 69.

Also, in case where the sheet P is contacted with the first actuator 84 and the first actuator 84 is thereby rotated counterclockwise in FIG. 3, the second actuator 86 is rotated counterclockwise in FIG. 3 together with the first actuator 84 to allow the light beam of the optical sensor 88 to penetrate, whereby the optical detector 88 detects that the sheet P has advanced into the delivery route 65.

(Operation)

Next, description will be given of the operation of the image forming apparatus 10 according to the present embodiment.

At first, description will be given of the delivery of the sheets P which are piled up on top of another and stored in the first sheet tray 34.

Figure 6:
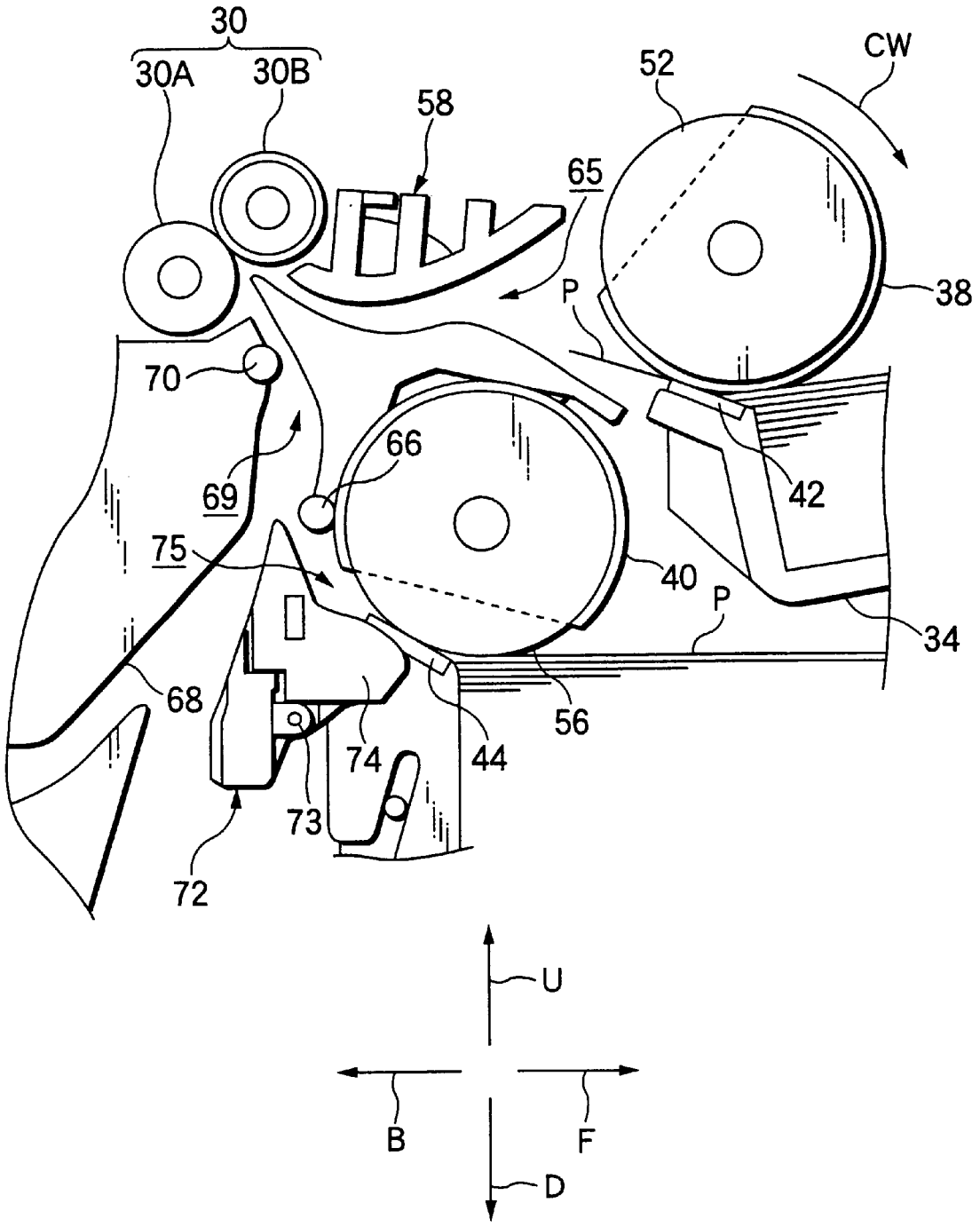
FIG. 6 is a side view of the main portions of the sheet feed apparatus, showing a state thereof in which the sheet feed apparatus starts to deliver the sheet using a first sheet feed roller.

As shown in FIG. 6, in case where the first sheet feed roller 38 is rotated in the arrow mark CW direction, the upper-most one of the sheets P in contact with the outer peripheral surface of the first sheet feed roller 38 is Fed toward the delivery route 65.

The first handling member 42 (and, similarly, the second handling member 44) is formed of a material having large friction with respect to the sheet P as conventional; and thus, when the sheets P are piled up on top of another, since the handling member 42 restricts the movement of the lower-side sheets P with a greater frictional force than a frictional force between the sheets P, only the upper-side sheet P is fed.

In case where the first sheet feed roller 38 is rotated further in the arrow mark CW direction and thus the sheet P advances into the delivery route 65, a leading end of the sheet P is guided by the upper-side guide surface 62 (the upper-side plane portion 62A and/or the arc portion 62B) so that the delivery direction of the sheet P is changed obliquely downwardly: and, in case where the sheet P is delivered further, the leading end of the sheet P is guided by the lower-side guide surface 60 (the second arc portion 60C) so that the delivery direction of the sheet P is changed obliquely upwardly, and then the sheet P is delivered toward between the rollers 30A and 30B.

Figure 7A:
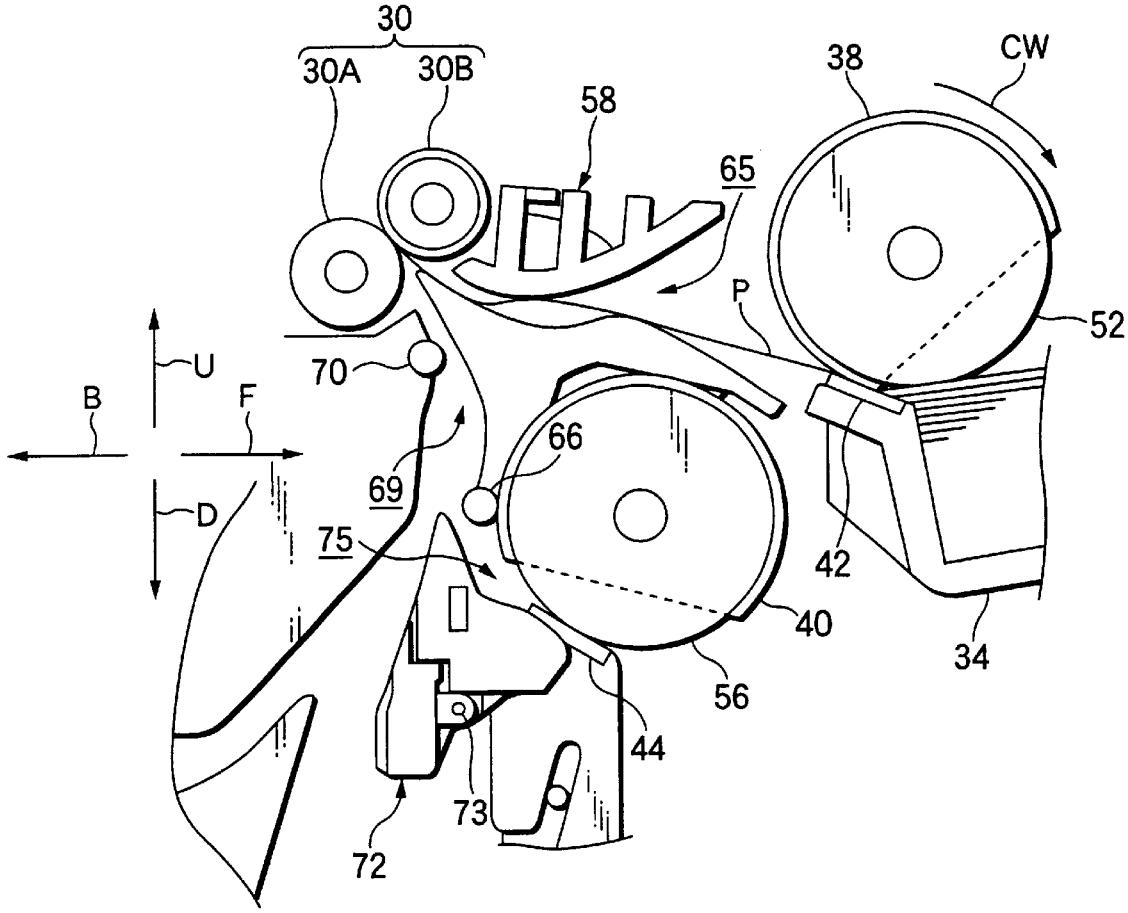
FIG. 7A is a side view of the main portions of the sheet feed apparatus, showing a state thereof in which the sheet is delivered further than in the state shown in FIG. 6; and, FIG. 7B is a perspective view of the sheet which is curved.
Figure 7B:
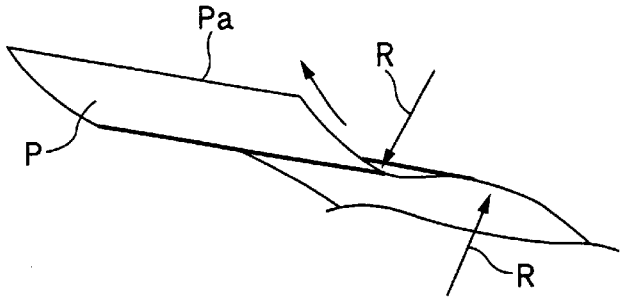

As shown in FIG. 7A, since the delivery direction of the sheet P is changed obliquely downwardly due to its first contact with the guide surface 62, the sheet P is curved in such a manner that the sheet P projects upwardly (see R in FIG. 7B) and, after then, since the delivery direction of the sheet P is changed obliquely upwardly, the sheet P is curved in such a manner that the sheet projects downwardly (see R in FIG. 7B). Therefore, as shown in FIG. 7B, the sheet P can be inserted into between the rollers 30A and 30B in such a manner that the leading end Pa of the sheet P is corrected into a linear shape, thereby eliminating a possibility that the sheet P is creased, while the sheet P is being held and delivered by the rollers 30A and 30B.

In case where the first sheet feed roller 38 is rotated once, the first sheet feed roller 38 stops. Also, in case where the sheet P advances into the delivery route 65, the first and second actuators 84 and 86 are rotated to allow the light beam of the optical sensor 88 to penetrate, whereby the optical sensor 88 detects the advancement of the sheet P into the delivery route 65; and, after passage of a predetermined time (which is previously set by the control unit 89), the registration roller 30 is rotated.

The sheet P held by the registration roller 30 is delivered further upwardly and, after passage of a predetermined time. (which is previously set by the control unit 89), writing of an image is started. The toner image on the image carrier 12 is transferred on the sheet P and the toner image is fixed by the fixing device 24.

Next, description will be given of a manner of delivery of the sheets P piled up on top of another and stored in the second sheet tray 36.

Figure 8:
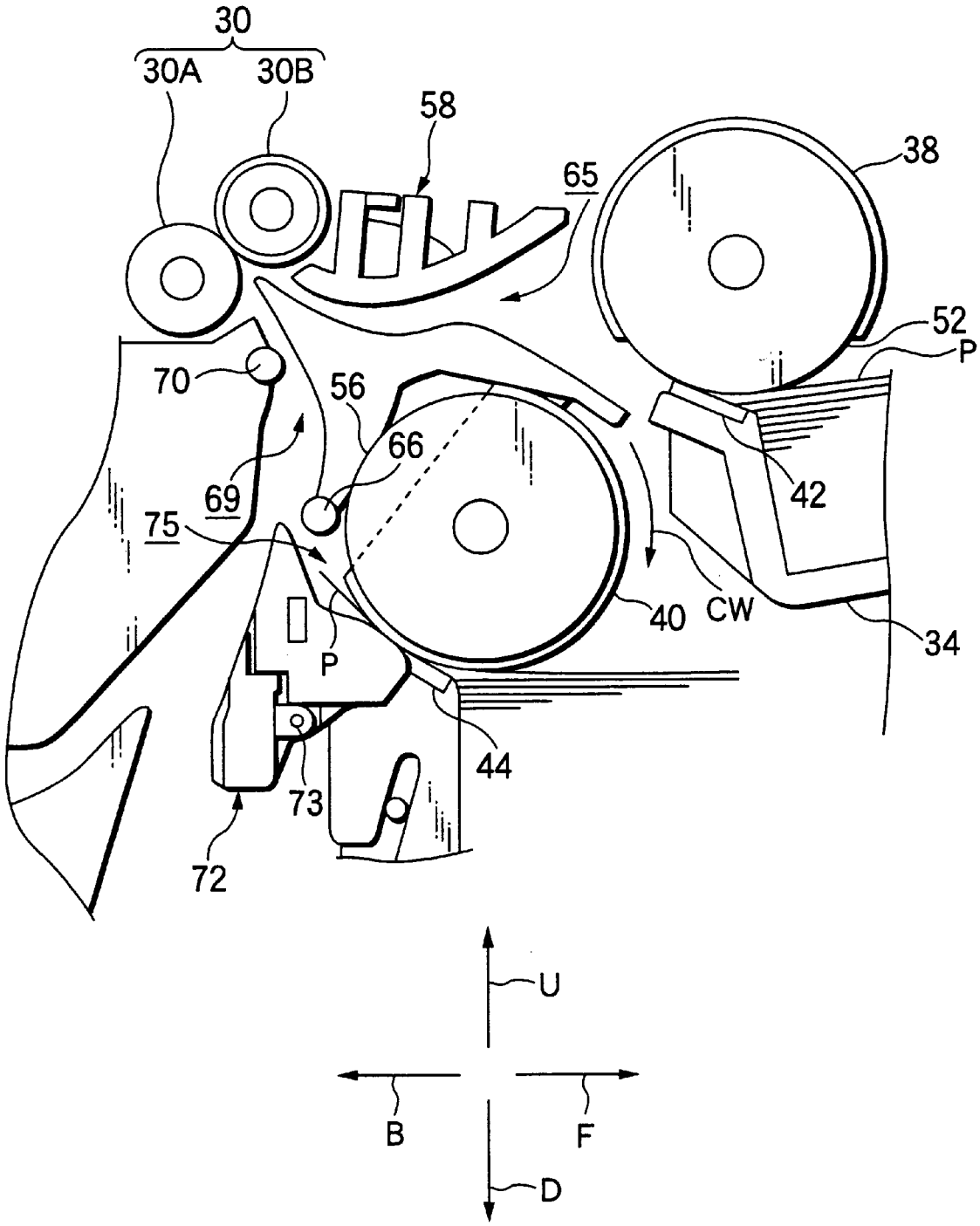
FIG. 8 is a side view of the main portions of the sheet feed apparatus, showing a state thereof in which the sheet feed apparatus starts to deliver the sheet using a second sheet feed roller.

As shown in FIG. 8, in case where the second sheet feed roller 40 is rotated in the arrow mark CW direction, the upper-most one of the sheets P, which is in contact with the outer peripheral surface of the second sheet feed roller 40, is delivered toward the delivery route 75.

In case where the second sheet feed roller 40 is rotated further in the arrow mark CW direction and whereby the sheet P is delivered, the leading end of the sheet P is guided while the sheet P is sequentially contacted with the fixed guide surface 72B, the guide surface 74B, the fixed guide surface 68, and the guide surface 64 in this order, and finally, the sheet P is directed into between the rollers 30A and 30S.

In the delivery routes 75 and 69, since the sheet P is sequentially contacted with the fixed guide surface 72B and the guide surface 74B, the fixed guide surface 68, and the guide surface 64 in this order, at first, the sheet P is curved so as to be convex in the arrow mark B direction and, after then, the sheet P is curved so as to be convex in the arrow mark F direction. Therefore, the sheet P can be inserted into between the rollers 30A and 30B in such a manner that the leading end of the sheet P is corrected into a linear shape, thereby eliminating the possibility that the sheet P is creased, while the sheet P is being held and delivered by the rollers 30A and 30B,.

In case where the second sheet feed roller 40 is rotated once, the second sheet feed roller 40 stops. Also, in case where the sheet P advances into the delivery route 69, the second actuators 86 is rotated and the light beam of the optical sensor 88 is allowed to penetrate, so that the advancement of the sheet P into the delivery route 69 is detected, and after passage of a predetermined time, the registration roller 30 is rotated.

The sheet P held by the registration roller 30 is delivered further upwardly, the toner image on the image carrier 12 is transferred onto the sheet P, and the toner image is fixed by the fixing device 24.

Figure 9:
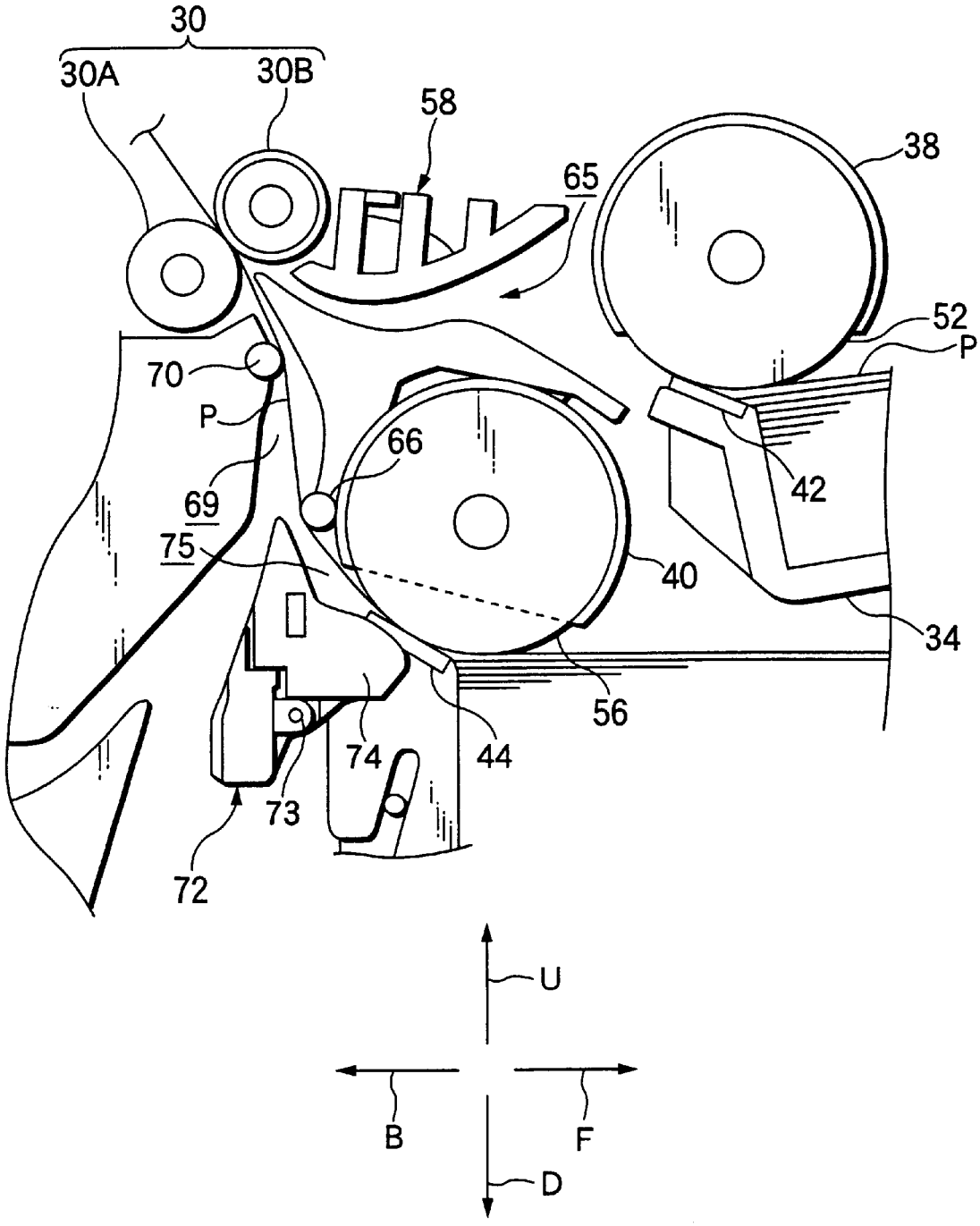
FIG. 9 is a side view of the main portions of the sheet feed apparatus, showing a state in which the sheet fed out by the second sheet feed roller is delivered by a registration roller.
Figure 10:
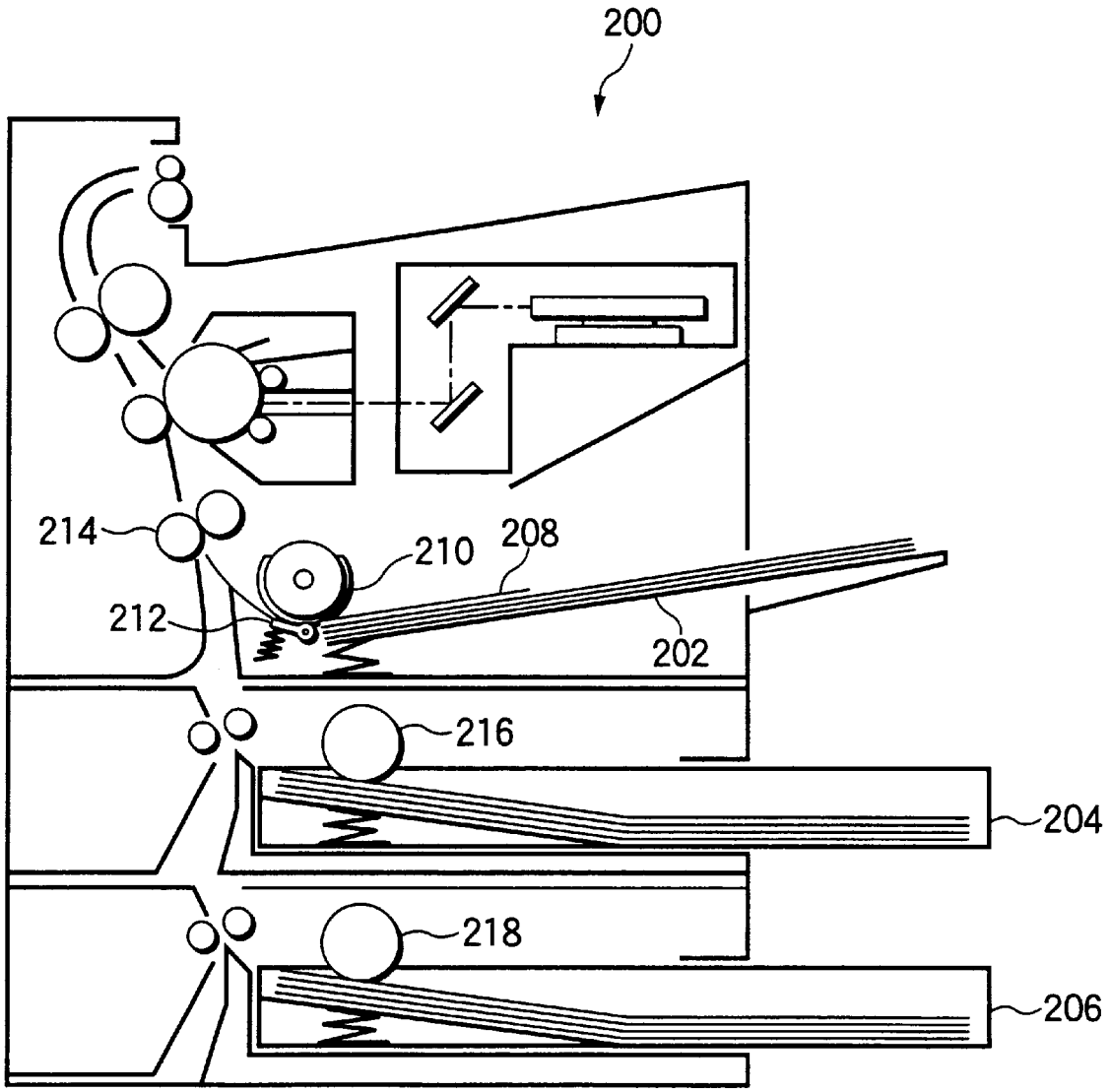
FIG.10 (PRIOR ART)
FIG. 10 is a schematic structure view of a image forming apparatus according to the related art.

Here, while the second sheet feed roller 40 is stopping and the sheet P is being delivered by the registration roller 30, as shown in FIG. 9, a rear side portion of the sheet P in the delivery direction is delivered by rotating the core roller 56 and slides together with the second handling member 44 and, therefore, tension acts on the sheet P between the registration roller 30 and second handling member 44, so that the sheet P is stretched. However, in this state, since the sheet P is contacted with the small-diameter rollers 66 and 70 only and the rollers 66 and 70 are rotated along with the movement of the sheet P, the sheet P can be delivered smoothly.

Especially, in a portion where the delivery route is short and the delivery direction of the sheet P is changed comparatively suddenly, as described above, preferably, the stretched sheet P is not allowed to slide on the guide surfaces but the sheet P is contacted with the rotatable rollers 66 and 70 only.

In the present embodiment, the nip portion of the registration roller 30 is interposed between the first tangent line L1, which passes through the handling portion between the first sheet feed roller 38 and first handling member 42, and the second tangent line L2 passing through the handling portion between the second sheet feed roller 40 and second handling member 44; the registration roller 30 is disposed below the horizontal line L3 passing through the upper end of the first sheet feed roller 38; and the first sheet feed roller 38, the second sheet feed roller 40, and the registration roller 30 are disposed so as to be as near as possible to one another. According to this, the height dimensions (the dimensions in the arrow mark U direction and in the arrow mark D direction) of the sheet feed apparatus 28 can be reduced to a minimum.

Also, since the second sheet feed roller 40 is interposed between the first sheet feed roller 38 and the registration roller 30 in the horizontal direction, the depth dimensions of the sheet feed apparatus 28 (the dimensions in the arrow mark F direction and in the arrow mark B direction) can be minimized as well as the height dimensions (the dimensions in the arrow mark U direction and in the arrow mark D direction) thereof.

This makes it possible to minimize the height dimensions and the depth dimensions of the image forming apparatus 10.

Also, since the lower-side second sheet feed roller 40 is disposed near to the registration roller 30, as the second sheet feed roller 40, it is possible to use a semilunar roller which is simple in structure and easy to control. This makes it possible not only to simplify the structure of the image forming apparatus 10 as much as possible but also to minimize the number of parts.

(Other Embodiments)

In the above-mentioned embodiment, the position of the registration roller 30 is set so as to project slightly upwardly of the first tangent line L1 passing through the handling portion between the first sheet feed roller 38 and first handling member 42. However, alternatively, of course, the position of the registration roller 30 may also be set downwardly of the first tangent line L1. That is, in case where the position of the registration roller 30 is set downwardly of the first tangent line L1, the positions of the parts (such as the developing unit 27) disposed upwardly of the registration roller 30 can be lowered further, which makes it possible to decrease the height dimensions of the image forming apparatus 10 further.

In the above-mentioned embodiment, the two small-diameter rollers (66, 70) are interposed between the second sheet feed roller 40 and the registration roller 30. However, the invention is not limited to this, but depending on the shape of the delivery route of the sheets P, the number of small-diameter rollers may be increased or decreased. And, it is also possible to employ another embodiment in which one or more small-diameter rollers are disposed in the delivery route 65 and the sheet P with tension applied thereto is connected only to the roller that can be rotated.

As has been described heretofore, according to the sheet feed apparatus and image forming apparatus of the invention, since the registration roller is interposed between the first tangent line, which passes through the handling portion between the first sheet feed roller and the first handling member, and the second tangent line passing through the handling portion between the second sheet feed roller and the second handling member, when the first sheet feed roller, the second sheet feed roller and the registration roller are disposed so as to be close to one another, the position of the registration roller can be lowered, which makes it possible to minimize the height dimensions of the image forming apparatus.

Also, according to a requirement, as the first and second sheet feed rollers, the invention can use a semilunar roller which is simple in structure and easy to control. This can simplify the structure of the image forming apparatus and also can minimize the number of parts to be used in the imaging forming apparatus.

What is claimed is:

1. A sheet feed apparatus, comprising:

a first sheet tray;

a second sheet trays disposed in a lower direction with respect to the first sheet tray;

a first sheet feed roller contacting with top one of sheets piled up to be stored in the first sheet tray, the first sheet feed roller adapted to feed the sheets;

a first handling member adapted to cooperate with the first sheet feed roller to prevent a plurality of the sheets stored in the first sheet tray from being fed together;

a second sheet feed roller contacting with top one of sheets piled up to be stored in the second sheet tray, the second sheet feed roller adapted to feed the sheets stored in the second sheet tray;

a second handling member adapted to cooperate with the second sheet feed roller to prevent a plurality of the sheets stored in the second sheet tray from being fed together;

a registration roller adapted to nip the sheets fed out from the first sheet tray and the sheets fed out from the second sheet tray to deliver the both sheets to an image forming section disposed in an upper direction with respect to the first sheet feed roller; and a first guide portion disposed between the first sheet feed roller and the registration roller, the first guide portion adapted to guide the sheets fed from the first sheet tray toward the registration roller, wherein the registration roller has two sub rollers, wherein a distance from a nip portion of the registration roller between the sub rollers to a handling portion between the second sheet feed roller and the second handling member is smaller than a distance from the nip portion of the registration roller to a nip portion between the first sheet feed roller and the first handling member, and wherein the first guide portion, comprises:

a first sheet curve forming portion adapted to curve a delivery direction of the sheet fed from the first sheet tray; and a second sheet curve forming portion disposed in downstream of the delivery direction with respect to the first sheet curve forming portion, the second sheet curve forming portion adapted to curve the delivery direction of the sheet fed from the first sheet tray in an opposite direction to the curving direction by the first curve forming portion.

2. A sheet feed apparatus, comprising:

a first sheet tray;

a second sheet trays disposed in a lower direction with respect to the first sheet tray;

a first sheet feed roller contacting with top one of sheets piled up to be stored in the first sheet tray, the first sheet feed roller adapted to feed the sheets;

a first handling member adapted to cooperate with the first sheet feed roller to prevent a plurality of the sheets stored in the first sheet tray from being fed together;

a second sheet feed roller contacting with top one of sheets piled up to be stored in the second sheet tray, the second sheet feed roller adapted to feed the sheets stored in the second sheet tray;

a second handling member adapted to cooperate with the second sheet feed roller to prevent a plurality of the sheets stored in the second sheet tray from being fed together;

a registration roller adapted to nip the sheets fed out from the first sheet tray and the sheets fed out from the second sheet tray to deliver the both sheets to an image forming section disposed in an upper direction with respect to the first sheet feed roller; and a first guide portion disposed between the first sheet feed roller and the registration roller, the first guide portion adapted to guide the sheets fed from the first sheet tray toward the registration roller, wherein the registration roller is disposed between a first tangent line passing through a handling portion between the first sheet feed roller and the first handling member, and a second tangent line passing through a handling portion between the second sheet feed roller and the second handling member, and wherein the first guide portion, comprises:

a first sheet curve forming portion adapted to curve a delivery direction of the sheet fed from the first sheet tray; and a second sheet curve forming portion disposed in downstream of the delivery direction with respect to the first sheet curve forming portion, the second sheet curve forming portion adapted to curve the delivery direction of the sheet fed from the first sheet tray in an opposite direction to the curving direction by the first curve forming portion.

3. The sheet feed apparatus according to claim 2, wherein in a horizontal direction, the second sheet feed roller is disposed between the first sheet feed roller and the registration roller.

4. A sheet feed apparatus, comprising:

a first sheet tray;

a second sheet trays disposed in a lower direction with respect to the first sheet tray;

a first sheet feed roller contacting with top one of sheets piled up to be stored in the first sheet tray, the first sheet feed roller adapted to feed the sheets;

a first handling member adapted to cooperate with the first sheet feed roller to prevent a plurality of the sheets stored in the first sheet tray from being fed together;

a second sheet feed roller contacting with top one of sheets piled up to be stored in the second sheet tray, the second sheet feed roller adapted to feed the sheets stored in the second sheet tray;

a second handling member adapted to cooperate with the second sheet feed roller to prevent a plurality of the sheets stored in the second sheet tray from being fed together;

a registration roller adapted to nip the sheets fed out from the first sheet tray and the sheets fed out from the second sheet tray to deliver the both sheets to an image forming section disposed in an upper direction with respect to the first sheet feed roller; and a second guide portion disposed between the second sheet feed roller and the registration roller, the second guide portion adapted to guide the sheets fed from the second sheet tray toward the registration roller, wherein the registration roller is disposed between a first tangent line passing through a handling portion between the first sheet feed roller and the first handling member, and a second tangent line passing through a handling portion between the second sheet feed roller and the second handling member, and wherein the second guide portion comprises at least one small-diameter roller contacting with any one of surfaces of the sheet fed from the second sheet tray to rotate.

5. An image forming apparatus, comprising:

an image forming section; and a sheet feed apparatus, comprising:

a first sheet tray;

a second sheet trays disposed in a lower direction with respect to the first sheet tray;

a first sheet feed roller contacting with top one of sheets piled up to be stored in the first sheet tray, the first sheet feed roller adapted to feed the sheets;

a first handling member adapted to cooperate with the first sheet feed roller to prevent a plurality of the sheets stored in the first sheet tray from being fed together;

a second sheet feed roller contacting with top one of sheets piled up to be stored in the second sheet tray, the second sheet feed roller adapted to feed the sheets stored in the second sheet tray;

a second handling member adapted to cooperate with the second sheet feed roller to prevent a plurality of the sheets stored in the second sheet tray from being fed together;

a registration roller adapted to nip the sheets fed out from the first sheet tray and the sheets fed out from the second sheet tray to deliver the both sheets to the image forming section; and a first guide portion disposed between the first sheet feed roller and the registration roller, the first guide portion adapted to guide the sheets fed from the first sheet tray toward the registration roller, wherein the image forming section is disposed in an upper direction with respect to the first sheet feed roller, wherein the registration roller is disposed between a first tangent line passing through a handling portion between the first sheet feed roller and the first handling member, and a second tangent line passing through a handling portion between the second sheet feed roller and the second handling member, and wherein the first guide portion, comprises:

a first sheet curve forming portion adapted to curve a delivery direction of the sheet fed from the first sheet tray; and a second sheet curve forming portion disposed in downstream of the delivery direction with respect to the first sheet curve forming portion, the second sheet curve forming portion adapted to curve the delivery direction of the sheet fed from the first sheet tray in an opposite direction to the curving direction by the first curve forming portion.

6. An image forming apparatus, comprising:

an image forming section; and a sheet feed apparatus, comprising:

a first sheet tray;

a second sheet trays disposed in a lower direction with respect to the first sheet tray;

a first sheet feed roller contacting with top one of sheets piled up to be stored in the first sheet tray, the first sheet feed roller adapted to feed the sheets;

a first handling member adapted to cooperate with the first sheet feed roller to prevent a plurality of the sheets stored in the first sheet tray from being fed together;

a second sheet feed roller contacting with top one of sheets piled up to be stored in the second sheet tray, the second sheet feed roller adapted to feed the sheets stored in the second sheet tray;

a second handling member adapted to cooperate with the second sheet feed roller to prevent a plurality of the sheets stored in the second sheet tray from being fed together;

a registration roller adapted to nip the sheets fed out from the first sheet tray and the sheets fed out from the second sheet tray to deliver the both sheets to an image forming section disposed in an upper direction with respect to the first sheet feed roller; and a second guide portion disposed between the second sheet feed roller and the registration roller, the second guide portion adapted to guide the sheets fed from the second sheet tray toward the registration roller, wherein the registration roller is disposed between a first tangent line passing through a handling portion between the first sheet feed roller and the first handling member, and a second tangent line passing through a handling portion between the second sheet feed roller and the second handling member, wherein the second guide portion comprises at least one small-diameter roller contacting with any one of surfaces of the sheet fed from the second sheet tray to rotate, and wherein the image forming section is disposed in an upper direction with respect to the first sheet feed roller.

7. An image forming apparatus, comprising:

an image forming section; and a sheet feed apparatus, comprising:

a first sheet tray;

a second sheet trays disposed in a lower direction with respect to the first sheet tray;

a first sheet feed roller contacting with top one of sheets piled up to be stored in the first sheet tray, the first sheet feed roller adapted to feed the sheets;

a first handling member adapted to cooperate with the first sheet feed roller to prevent a plurality of the sheets stored in the first sheet tray from being fed together;

a second sheet feed roller contacting with top one of sheets piled up to be stored in the second sheet tray, the second sheet feed roller adapted to feed the sheets stored in the second sheet tray;

a second handling member adapted to cooperate with the second sheet feed roller to prevent a plurality of the sheets stored in the second sheet tray from being fed together;

a registration roller adapted to nip the sheets fed out from the first sheet tray and the sheets fed out from the second sheet tray to deliver the both sheets to an image forming section disposed in an upper direction with respect to the first sheet feed roller; and a first guide portion disposed between the first sheet feed roller and the registration roller, the first guide portion adapted to guide the sheets fed from the first sheet tray toward the registration roller, wherein the registration roller has two sub rollers, wherein a distance from a nip portion of the registration roller between the sub rollers to a handling portion between the second sheet feed roller and the second handling member is smaller than a distance from the nip portion of the registration roller to a nip portion between the first sheet feed roller and the first handling member, wherein the first guide portion, comprises:

a first sheet curve forming portion adapted to curve a delivery direction of the sheet fed from the first sheet tray; and a second sheet curve forming portion disposed in downstream of the delivery direction with respect to the first sheet curve forming portion, the second sheet curve forming portion adapted to curve the delivery direction of the sheet fed from the first sheet tray in an opposite direction to the curving direction by the first curve forming portion; and wherein the image forming section is disposed in an upper direction with respect to the first sheet feed roller.

8. An image forming apparatus, comprising:

an image forming section; and a sheet feed apparatus, comprising:

a first sheet tray;

a second sheet trays disposed in a lower direction with respect to the first sheet tray;

a first sheet feed roller contacting with top one of sheets piled up to be stored in the first sheet tray, the first sheet feed roller adapted to feed the sheets;

a first handling member adapted to cooperate with the first sheet feed roller to prevent a plurality of the sheets stored in the first sheet tray from being fed together;

a second sheet feed roller contacting with top one of sheets piled up to be stored in the second sheet tray, the second sheet feed roller adapted to feed the sheets stored in the second sheet tray;

a second handling member adapted to cooperate with the second sheet feed roller to prevent a plurality of the sheets stored in the second sheet tray from being fed together;

a registration roller adapted to nip the sheets fed out from the first sheet tray and the sheets fed out from the second sheet tray to deliver the both sheets to an image forming section disposed in an upper direction with respect to the first sheet feed roller; and a second guide portion disposed between the second sheet feed roller and the registration roller, the second guide portion adapted to guide the sheets fed from the second sheet tray toward the registration roller, wherein the registration roller has two sub rollers, wherein a distance from a nip portion of the registration roller between the sub rollers to a handling portion between the second sheet feed roller and the second handling portion between the second sheet feed roller and the second handling member is smaller than a distance from the nip portion of the registration roller to a nip portion between the first sheet feed roller and the first handling member, wherein the second guide portion comprises at least one small-diameter roller contacting with any one of surfaces of the sheet fed from the second sheet tray to rotate, and wherein the image forming section is disposed in an upper direction with respect to the first sheet feed roller.

9. A sheet feed apparatus, comprising:

a first sheet tray;

a second sheet trays disposed in a lower direction with respect to the first sheet tray;

a first sheet feed roller contacting with top one of sheets piled up to be stored in the first sheet tray, the first sheet feed roller adapted to feed the sheets;

a first handling member adapted to cooperate with the first sheet feed roller to prevent a plurality of the sheets stored in the first sheet tray from being fed together;

a second sheet feed roller contacting with top one of sheets piled up to be stored in the second sheet tray, the second sheet feed roller adapted to feed the sheets stored in the second sheet tray;

a second handling member adapted to cooperate with the second sheet feed roller to prevent a plurality of the sheets stored in the second sheet tray from being fed together;

a registration roller adapted to nip the sheets fed out from the first sheet tray and the sheets fed out from the second sheet tray to deliver the both sheets to an image forming section disposed in an upper direction with respect to the first sheet feed roller; and a second guide portion disposed between the second sheet feed roller and the registration roller, the second guide portion adapted to guide the sheets fed from the second sheet tray toward the registration roller, wherein the registration roller has two sub rollers, wherein a distance from a nip portion of the registration roller between the sub rollers to a handling portion between the second sheet feed roller and the second handling portion between the second sheet feed roller and the second handling member is smaller than a distance from the nip portion of the registration roller to a nip portion between the first sheet feed roller and the first handling member, and wherein the second guide portion comprises at least one small-diameter roller contacting with any one of surfaces of the sheet fed from the second sheet tray to rotate.

* * * * *